US007628619B2

(12) United States Patent
Chuang

(10) Patent No.: US 7,628,619 B2
(45) Date of Patent: Dec. 8, 2009

(54) VIDEO DISPLAY CONNECTOR HAVING PROTECTION CIRCUIT

(76) Inventor: Yi-Fang Chuang, 5F., No. 15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/190,023

(22) Filed: Aug. 12, 2008

(65) Prior Publication Data

US 2009/0142959 A1 Jun. 4, 2009

(30) Foreign Application Priority Data

Nov. 30, 2007 (TW) ..... 96220423 U

(51) Int. Cl.
*H01R 12/00* (2006.01)

(52) U.S. Cl. ..... 439/76.1; 439/620.22; 439/620.08

(58) Field of Classification Search ..... 439/76.1, 439/620.22, 620.24, 620.08
See application file for complete search history.

(56) References Cited

U.S. PATENT DOCUMENTS 4,889,497 A * 12/1989 Riches ..... 439/76.1
5,052,949 A * 10/1991 Lopata et al. ..... 439/610
6,450,837 B1 * 9/2002 Givens et al. ..... 439/620.19
2008/0096429 A1 * 4/2008 Mikolajczak et al. .. 439/620.08

* cited by examiner

*Primary Examiner*—Ross N Gushi
(74) *Attorney, Agent, or Firm*—Chun-Ming Shih

(57) ABSTRACT

A video display connector having protection circuit includes an insulating stand, a conducting terminal array fixedly connected to the insulating stand, a circuit board disposed in correspondence with the insulating stand and providing electrical connection to a lateral end of the conducting terminal array, a protective element electrically connected with the circuit board and forming a protective circuit therewith, and a transmission line disposed on and electrically connected to the circuit board, the disposition of the transmission line being spatially apart from the insulating stand. Through providing a protection circuit within the video display connector, the main circuit board of the electronic apparatus is shielded from current overload originating from an external audio/video device when the electronic apparatus is connected thereto through the contact terminals of the video display connector.

6 Claims, 4 Drawing Sheets

VIDEO DISPLAY CONNECTOR HAVING PROTECTION CIRCUIT

BACKGROUND OF THE INVENTION

1. Field of the Invention

The present invention generally relate to a connector, and in particular, to a video display connector having protection circuit.

2. Description of Prior Art

Video display connectors, such as ones compatible with the DisplayPort digital display interface standard, allow the transfer of audio and video data in digital quality. DisplayPort connectors currently support a maximum bandwidth of 10.8 Gbps data rate, providing audio and video signals in high quality and resolution.

Conventional video display connectors are comprised of an insulating body, a metallic housing, and contact terminals. After the contact terminals are first installed within the insulating body, the insulating body is disposed within the metallic housing. To connect to an electronic device, such as a personal computer, the pins on one end of the contact terminals protruding out of the metallic housing of the video display connector are electrically connected to the main circuit board of the electronic device. To use, the video display connector is connected to an external device, such as an audio/video device, and a corresponding port on the electronic device, whereby audio/video signals are transferred from the former to the main circuit board of the latter.

SUMMARY OF THE INVENTION

In one aspect, the invention features a video display connector having protection circuit, comprising an insulating stand, a conducting terminal array fixedly connected to the insulating stand, a circuit board disposed in correspondence with the insulating stand and providing electrical connection to a lateral end of the conducting terminal array, a protective element electrically connected with the circuit board and forming a protective circuit therewith, and a transmission line disposed on and electrically connected to the circuit board, the disposition of the transmission line being spatially apart from the insulating stand.

Embodiments may include one or more of the following advantages. Through providing a protection circuit within the video display connector, the main circuit board of the electronic apparatus is shielded from current overload, which originates from an external audio/video device connected to the electronic device through the contact terminals of the video display connector. For example, when current overload or signal spikes results from abnormal operation of the external device, or when the external device is struck by lightning, or when the video display connector is improperly removed, the implementation of circuit protection shields the excessive current from damaging the main circuit board of the electronic device.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

Figure 1:
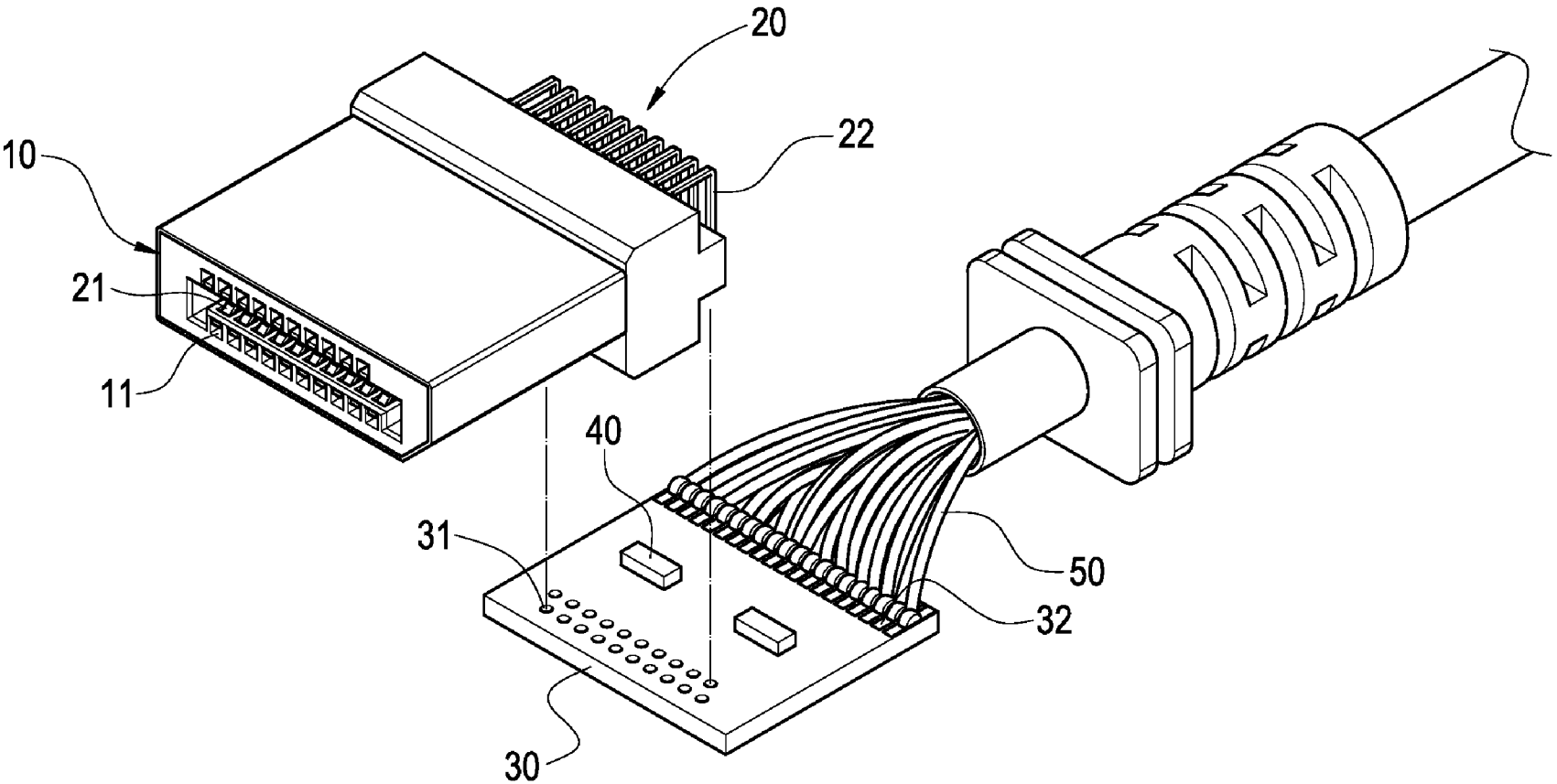
FIG. 1 is a perspective explosive illustration of a first embodiment of a video display connector having protection circuit.
Figure 2:
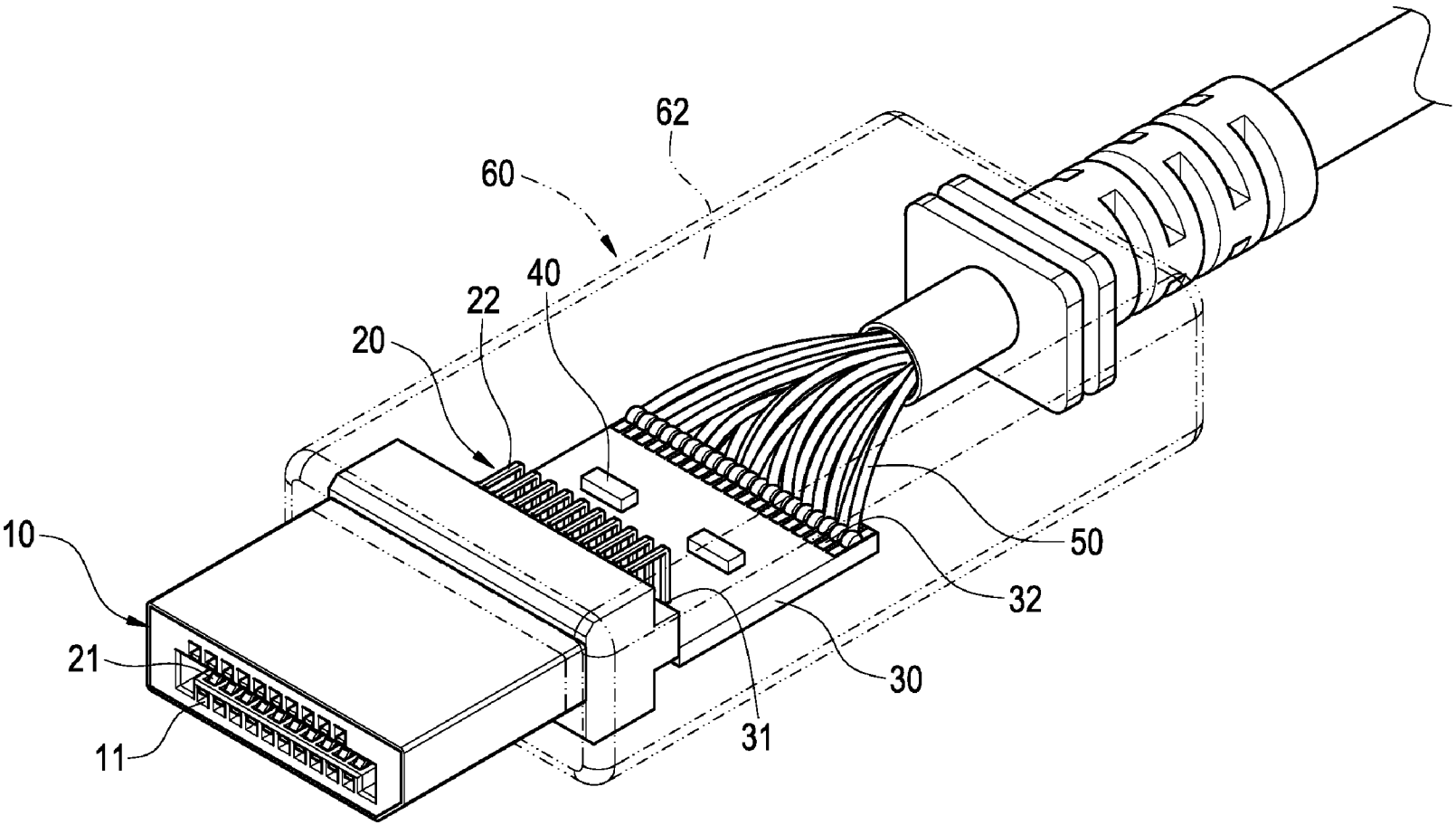
FIG. 2 is a perspective assembled illustration of the first embodiment of a video display connector having protection circuit.
Figure 3:
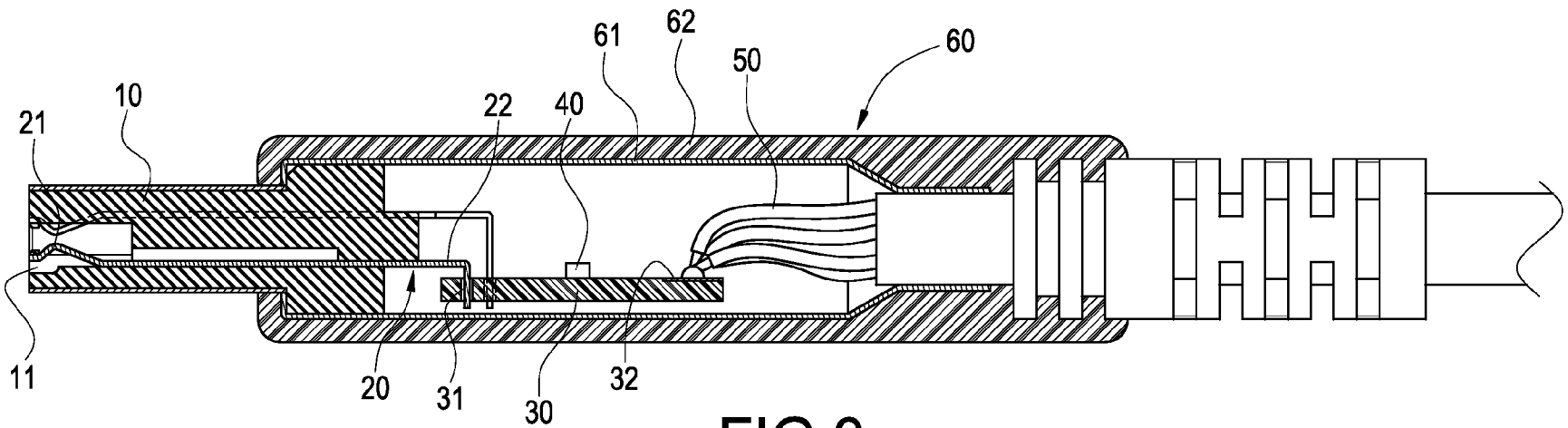
FIG. 3 is a side cross-sectional view of the first embodiment of a video display connector having protection circuit.

FIGS. 1-3 respectively show a first embodiment of a video display connector having protection circuit in a perspective explosive view, 3-D assembled view, and side cross-sectional view. The video display connector having protection circuit includes an insulating stand 10, a conducting terminal array 20, a circuit board 30, a protective element 40, a transmission line 50, and a housing assembly 60. Insulating stand 10 is defined therein a plurality of through-holes 11 bored through the front side and back side thereof. Conducting terminal array 20 is fitted through through-holes 11 and fixedly connected to insulating stand 10.

Conducting terminal array 20 includes a plurality of front pins 21 and a plurality of back pins 22 extended from the back end of front pins 21. Front pins 21 and back pins 22 are relatively perpendicular from each other. Front pins 21 are fitted through through-holes 11. Back pins 22 are disposed at the back end of insulating stand 10 on the outer periphery thereof.

Circuit board 30 is disposed in correspondence with insulating stand 10 and provides electrical connection to a lateral end of conducting terminal array 20. Circuit board 30 is defined on one end a plurality of pin holes 31. Back pins 22 are configured to fit through pin holes 31 and electrically connect with circuit board 30. Protective element 40 is electrically connected with circuit board 30 and forms a protective circuit therewith. Protective element 40 can be a semiconductor element. Protective element 40 can have the following functions:

1. Protective element protects from short-circuit. When circuit board 30 experiences short circuit, protective element 40 can shield outgoing current from entering into a device connected to the video display connector such that that the device system can remain in operation unaffected by the short circuit.
2. Protective element 40 also regulates current output to prevent device damage. Protective element 40 considers power supply output capability and chooses current standard supported by circuit board 30 for output, thereby preventing damage to the circuit board 30 from overload.
3. Protective element 40 also provides counter-current protection. When an external device connected to the video display connector stops outputting current, the receiving end circuit board 30 still has current flowing through it. Protective element 40 operates to prevent the current in circuit board 30 from flowing back to the external device and causing damage to external device's internal circuit and electronic elements.

4. Protective element 40 further prevents device damage from overheating. When excessive current in a device connected to the video display connector on the current receiving end causes the device temperature to exceed safe operating temperature, protective element 40 triggers its protective mechanism to stop current output to that electronic device.
5. Protective element 40 also provides low voltage protection. Where exceedingly low voltage prevents external device from operating normally, protective element 40 functions to maintain the output voltage to ensure the external device remains in operable conditions.

Transmission line 50 is disposed on and electrically connected to another end of circuit board 30. Specifically, the other end of circuit board 30 is defined a plurality of electrical terminals 32 configured to electrically connect with transmission line 50.

In some embodiments, video display connector having protection circuit further includes a housing assembly 60 comprised of a metallic housing 61 and an insulating housing 62 surrounding an outer surface of the metallic housing 61. Metallic housing 61 receives the insulating stand 10, circuit board 30 and transmission line 50 therein. As shown in FIG. 3, the metallic housing 61 has one end defining a cavity receiving the circuit board 30 and one end of the insulating stand 10 therein. The insulating housing 62 surrounding an outer surface of said end of the metallic housing 61. and another end of the metallic housing 61 protrudes outwardly from the insulating housing 62 and surrounding another end of the insulating stand 10.

In some embodiments, metallic housing 61 has one end sealing the insulating stand 10 and another end sealing the transmission line 50. Metallic housing 61 is further defined a cavity configured to house back pins 22 and circuit board 30 therein.

Accordingly, through the invention, when the external audio/video device is under abnormal operation, is struck by lightning, or when the video display connector is improperly removed, protective element 40 of the protective circuit on circuit board 30 shields the resulting current overload or signal spikes from entering the external audio/video device and damaging the main circuit board (not shown) therein.

Figure 4:
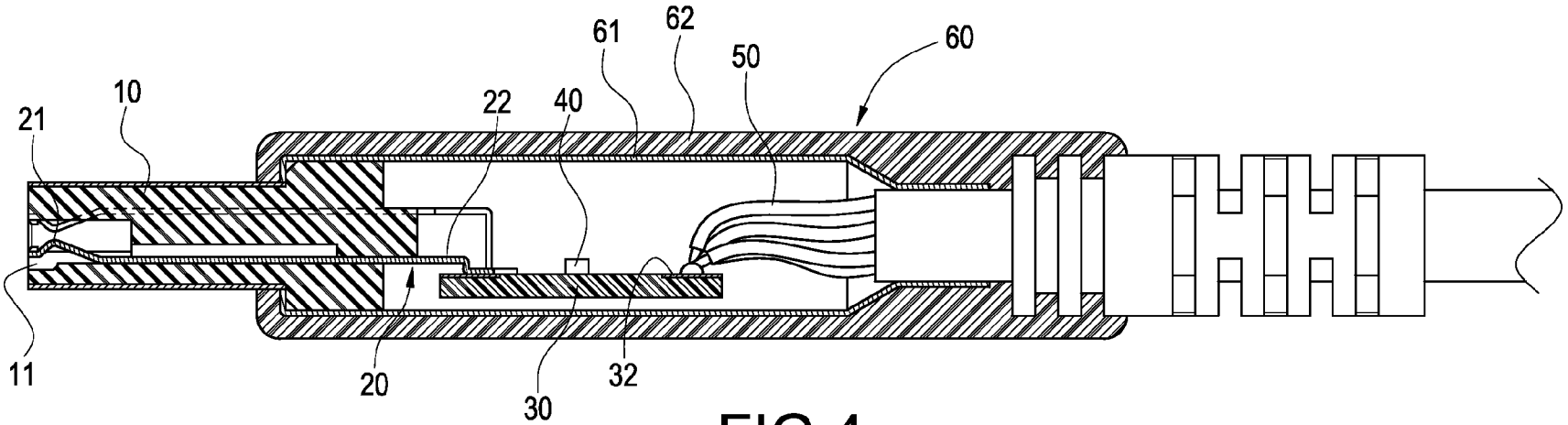
FIG. 4 is a side cross-sectional view of a second embodiment of a video display connector having protection circuit.
Figure 5:
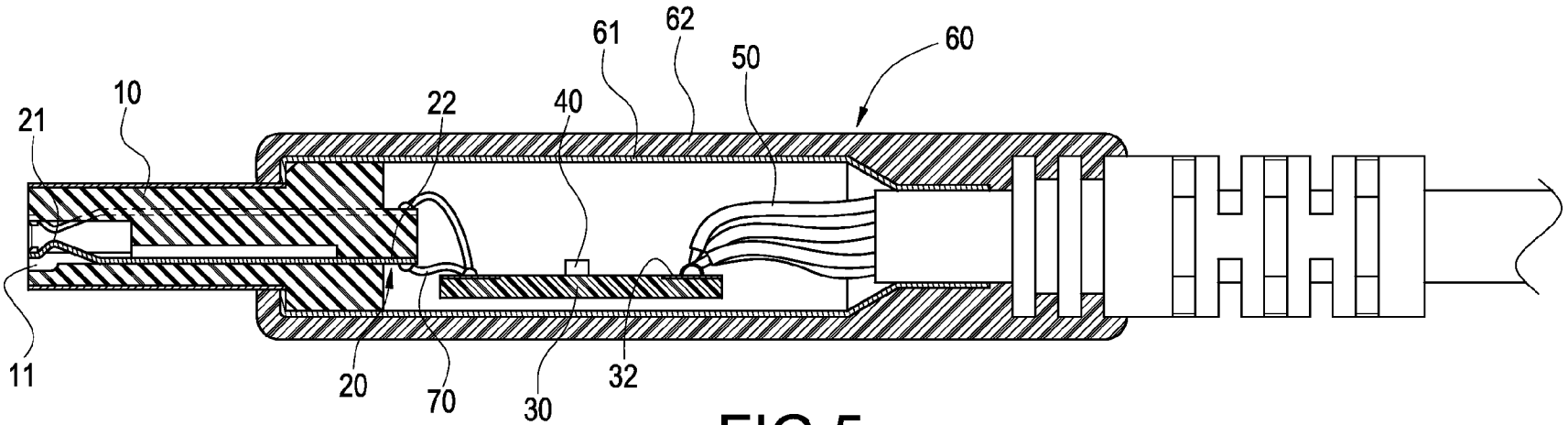
FIG. 5 is a side cross-sectional view of a third embodiment of a video display connector having protection circuit.

FIGS. 4 and 5 respectively show side cross-sectional views of a second and third embodiment of a video display connector having protection circuit. As opposed to back pins 22 being perpendicular to front pins 21 as shown, for example, in FIG. 1, back pins 22 can alternatively be shaped at an angle substantially parallel to the front pins 21 and configured to electrically connect with one end of circuit board 30. This pin configuration eliminates the need to bore pin holes on circuit board 30, thereby reducing manufacturing steps and costs. Additionally, conducting wires 70 can also be used to electrically connect back pins 22 with one end of circuit board 30. To solidify connection, conducting wires 70 can be soldered to back pins 22 and one end of circuit board 30 to increase data transfer stability and reduce the chances of poor electrical contact after the video display connector is repetitively plugged/unplugged from devices.

What is claimed is:

1. A video display connector having protection circuit, comprising:

an insulating stand;

a conducting terminal array, fixedly connected to the insulating stand;

a circuit board, disposed in correspondence with the insulating stand, and providing electrical connection to a lateral end of the conducting terminal array;

a protective element, electrically connected to the circuit board and forming a protective circuit therewith;

a transmission line, disposed on and electrically connected to the circuit board, the disposition of the transmission line being spatially apart from the insulating stand; and a housing assembly comprised of a metallic housing and an insulating housing, the metallic housing having one end defining a cavity receiving the circuit board and one end of the insulating stand therein, the insulating housing surrounding an outer surface of the end of the metallic housing, and another end of the metallic housing protruding outwardly from the insulating housing and surrounding another end of the insulating stand.

2. The video display connector having protection circuit according to claim 1, wherein the protective element is a semiconductor element.

3. The video display connector having protection circuit according to claim 1, wherein the insulating stand is defined therein a plurality of through-holes bored through the front side and back side thereof, the conducting terminal array being fitted through the through-holes.

4. The video display connector having protection circuit according to claim 3, wherein the conducting terminal array comprises a plurality of front pins and a plurality of back pins extended from the back end of the front pins, the front and back pins being relatively perpendicular, the front pins being fitted through the through-holes, the back pins being disposed at the back end of the insulating stand on the outer periphery thereof.

5. The video display connector having protection circuit according to claim 4, wherein the circuit board is defined on one end a plurality of pin holes, the back pins being configured to fit through the pin holes and electrically connect with the circuit board.

6. The video display connector having protection circuit according to claim 5, wherein the circuit board is defined on another end a plurality of electrical terminals configured to electrically connect with the transmission line.

* * * * *